US010358287B2

(12) United States Patent
McNeilus et al.

(10) Patent No.: US 10,358,287 B2
(45) Date of Patent: Jul. 23, 2019

(54) AUTOMATED CONTAINER HANDLING SYSTEM FOR REFUSE COLLECTION VEHICLES

(71) Applicant: Con-Tech Manufacturing, Inc., Dodge Center, MN (US)

(72) Inventors: Grant McNeilus, Dodge Center, MN (US); James R. Cunningham, Rochester, MN (US); Brian R. Meldahl, Brownsdale, MN (US)

(73) Assignee: Con-Tech Manufacturing, Inc., Dodge Center, MN (US)

( * ) Notice: Subject to any disclaimer, the term of this patent is extended or adjusted under 35 U.S.C. 154(b) by 0 days.

(21) Appl. No.: 15/189,150

(22) Filed: Jun. 22, 2016

(65) Prior Publication Data

US 2017/0369242 A1 Dec. 28, 2017

(51) Int. Cl.

| | |
|---|---|
| ***B65F 1/12*** | (2006.01) |
| ***B65F 3/04*** | (2006.01) |
| ***B65F 3/06*** | (2006.01) |
| *B65F 3/02* | (2006.01) |

(52) U.S. Cl.

CPC ..... *B65F 3/046* (2013.01); *B65F 3/06* (2013.01); *B65F 2003/023* (2013.01); *B65F 2003/025* (2013.01); *B65F 2003/0276* (2013.01); *B65F 2003/0283* (2013.01)

(58) Field of Classification Search

CPC ..... B65F 1/122
USPC ..... 414/408
See application file for complete search history.

(56) References Cited

U.S. PATENT DOCUMENTS

| | | | | |
|---|---|---|---|---|
| 8,224,500 | B2 | 7/2012 | Anderson | |
| 8,392,065 | B2 | 3/2013 | Tolstedt et al. | |
| 8,807,613 | B2 | 8/2014 | Howell et al. | |
| 8,810,361 | B2 | 8/2014 | Thukral et al. | |
| 9,346,400 | B2 | 5/2016 | Attard et al. | |
| 2006/0153667 | A1* | 7/2006 | Pruteanu | B65F 3/046 414/408 |
| 2012/0277932 | A1 | 11/2012 | Anderson | |
| 2013/0039728 | A1* | 2/2013 | Price | B65F 3/043 414/408 |

(Continued)

FOREIGN PATENT DOCUMENTS

| | | |
|---|---|---|
| EP | 0928756 | 7/1999 |
| EP | 1 020 375 | 7/2000 |

OTHER PUBLICATIONS

Examination Search Report dated Oct. 4, 2017.

*Primary Examiner* — Saul Rodriguez
*Assistant Examiner* — Willie Berry, Jr.
(74) *Attorney, Agent, or Firm* — Craig J. Lervick; Larkin Hoffman Daly & Lindgren, Ltd.

(57) ABSTRACT

A fully automated container handling system for a refuse vehicle is provided that utilizes a vehicle-mounted video camera which feeds video to a cab-mounted monitor to inform a driver of the location of a container of interest enabling accurate alignment of the vehicle. The system is operated by a single button in the cab and includes an extending, pivoting arm with a base equipped with a converging grabber to seize and empty the container. The base that grabs the container includes a sonar transducer that functions with a hydraulic system that operates the arm and grabber using a programmable logic controller (PLC) computer program to run the hydraulic controls.

13 Claims, 7 Drawing Sheets

(56) References Cited

U.S. PATENT DOCUMENTS

2014/0343801 A1* 11/2014 Whitfield, Jr. ..... B65F 3/041
701/49

* cited by examiner

AUTOMATED CONTAINER HANDLING SYSTEM FOR REFUSE COLLECTION VEHICLES

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to automating refuse collection vehicles and, more particularly, to a system for handling refuse containers that automatically approaches, grabs and picks up refuse containers, empties the containers into the refuse vehicle and returns the container back to the exact location where it was picked up. The system employs a vehicle-mounted camera for aligning a container handling arm with a container of interest and employs a sonar transducer located in a base portion of the arm that includes a converging grabber that seizes and releases a container for more precise control.

II. Related Art

Refuse vehicles have long played an important role in the collection and transporting of refuse by stopping at numerous locations along a route where refuse containers that have been filled with refuse await collection, handling the containers to deposit the contents in the refuse vehicle, transporting the refuse, and discharging it at a processing center such as a land fill or recycling center.

In this regard, there has been a growing need to increase efficiency by further automating the collection aspect of the operation, particularly with respect to reducing the need for manual interaction in the handling of refuse containers. While the lift and dump portion of the container handling operation have generally been mechanized, it has been necessary for the refuse truck driver to manually align the vehicle with a container of interest and, in the case of a side-loading vehicle, manually control the operation of an arm that includes a base that grabs and releases a container, initiate a dump cycle, and manually retract the arm to a stowed position. Thus, there remains a need to more fully automate the container handling phase of the operation that eliminates accidental tipping of containers which often occurs with a manual arm extension operation as well as other problems which occur due to lack of precision.

SUMMARY OF THE INVENTION

A fully automated container handling system for a refuse vehicle is provided that utilizes a vehicle-mounted video camera which feeds video to a cab-mounted monitor to inform a driver of the location of a container of interest enabling accurate alignment of the vehicle. The system includes an extending, pivoting arm with a base equipped with a converging grabber to seize and empty the container. The base that grabs the container includes a sonar transducer that functions with a hydraulic system that operates the arm and grabber using a programmable logic controller (PLC) computer program to run the hydraulic controls. An illustrative preferred embodiment is shown mounted on a side-loading refuse vehicle. A seized container is hoisted along the pivoting arm by a chain, cable or belt, as the base assembly is mounted to move along the arm.

In operation, the vehicle driver pulls up next to a refuse container to be emptied using the camera to locate the container and stops the vehicle when the container appears on the monitor. The driver then activates a safety on/off finger trigger, or the like, on a joy stick installed in the cab next to the driver and pushes another button on the joy stick to activate the PLC program which controls the arm during the container emptying cycle. The container emptying cycle is initiated with the arm in the stowed position. The arm pivots, extending the base outward toward the container until the sonar transducer indicates the desired proximity of the container before hitting the container. This distance might be as close as one inch (2.5 cms). The grabber is then activated to close around and seize the container. The arm then retracts and lifts and dumps the contents of the container into a receiving zone of the vehicle body. The steps are then reversed to return the container to the exact location where it was picked up, release the container and return the arm to the stowed or home position. The entire cycle is accomplished by the operation of a single button in the cab.

The use of sonar and cameras together enables the process to be completely automated and eliminates common problems associated with arm operation including hitting and tipping of containers.

DETAILED DESCRIPTION

The following detailed description is intended to be exemplary of a preferred apparatus and method of utilizing the concepts of the present invention and is not intended to exhaustive or limiting in any manner with respect to similar devices and methods and other variations which might occur to those skilled in the art. The following description further utilizes an illustrative example which is believed sufficient to convey an adequate understanding of the broader concepts to those skilled in the art, and exhaustive examples are believed unnecessary.

Figure 1:
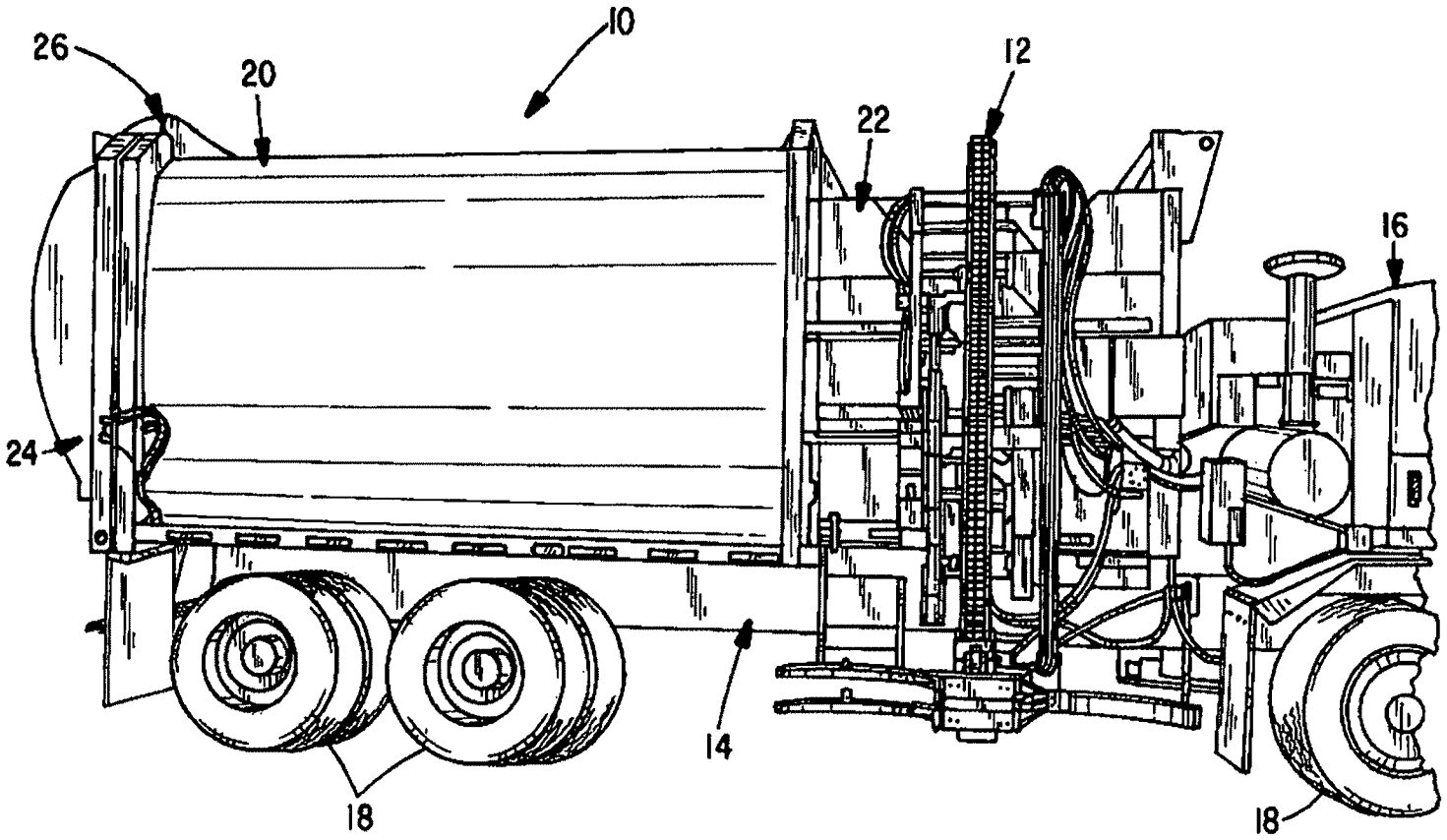
FIG. 1 is a side elevational view of a side-loading refuse truck provided with the automated container handling system of the invention.
Figure 2:
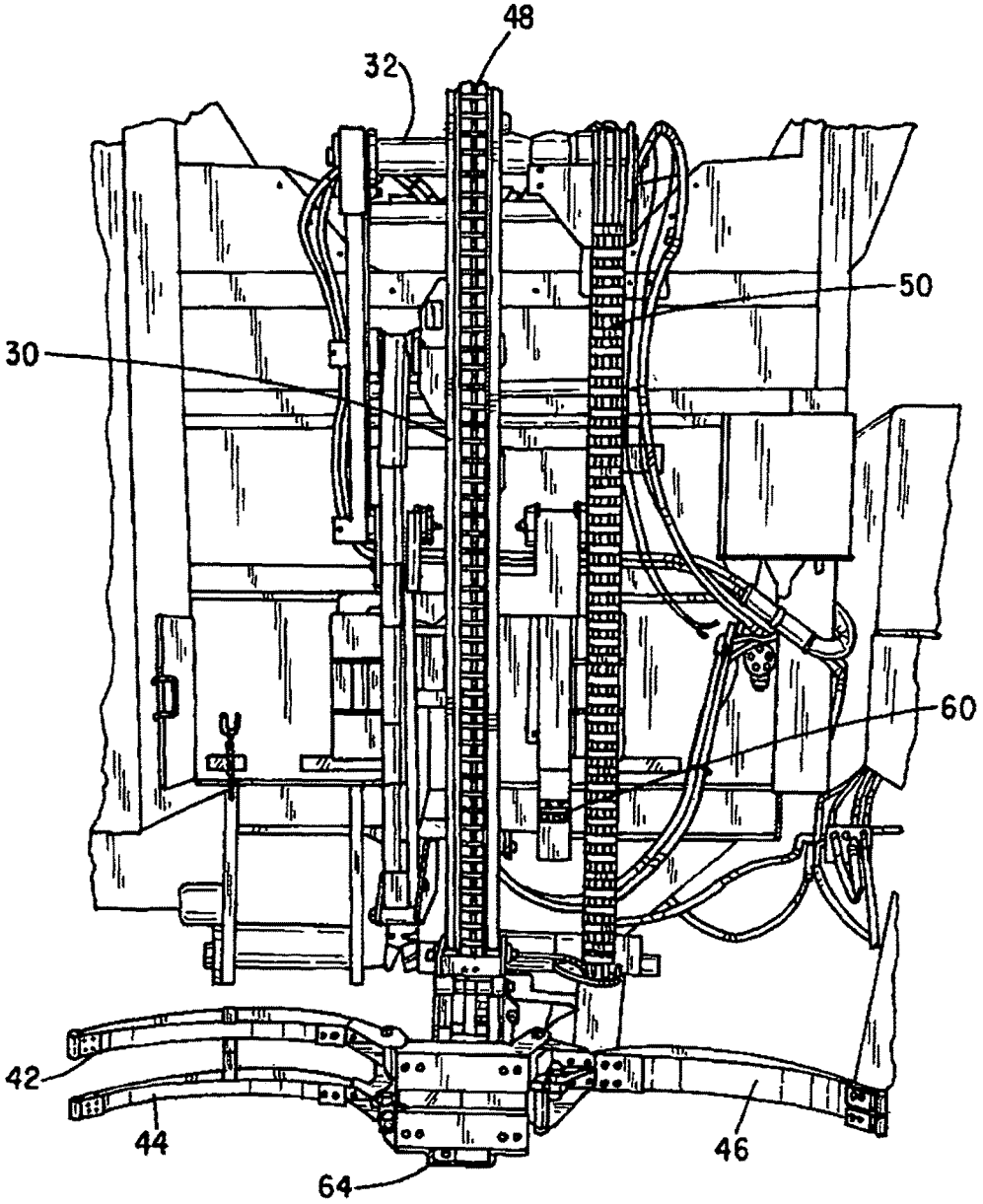
FIG. 2 is an enlarged view of the container handling system depicted in FIG. 1.

FIG. 1 depicts a side elevational view of a side-loading refuse truck, generally at 10, incorporating the container handling system of the invention, shown generally at 12, mounted on the truck. The vehicle includes a chassis 14, a cab shown partially at 16 and wheels 18. The vehicle body includes a storage chamber 20 which is connected to a charging hopper 22 and a tailgate 24 which is pivotally carried by a pair of vertically operating hinges, one of which is shown at 26 mounted at the top rear of the storage chamber. The tailgate is operated to open and close by hydraulic cylinders (not shown) and the vehicle body in conjunction with the operation of the tailgate, is tilted by further hydraulic cylinders (also not shown), to discharge stored refuse. Operation of the tailgate and truck body are well known.

Figure 3A:
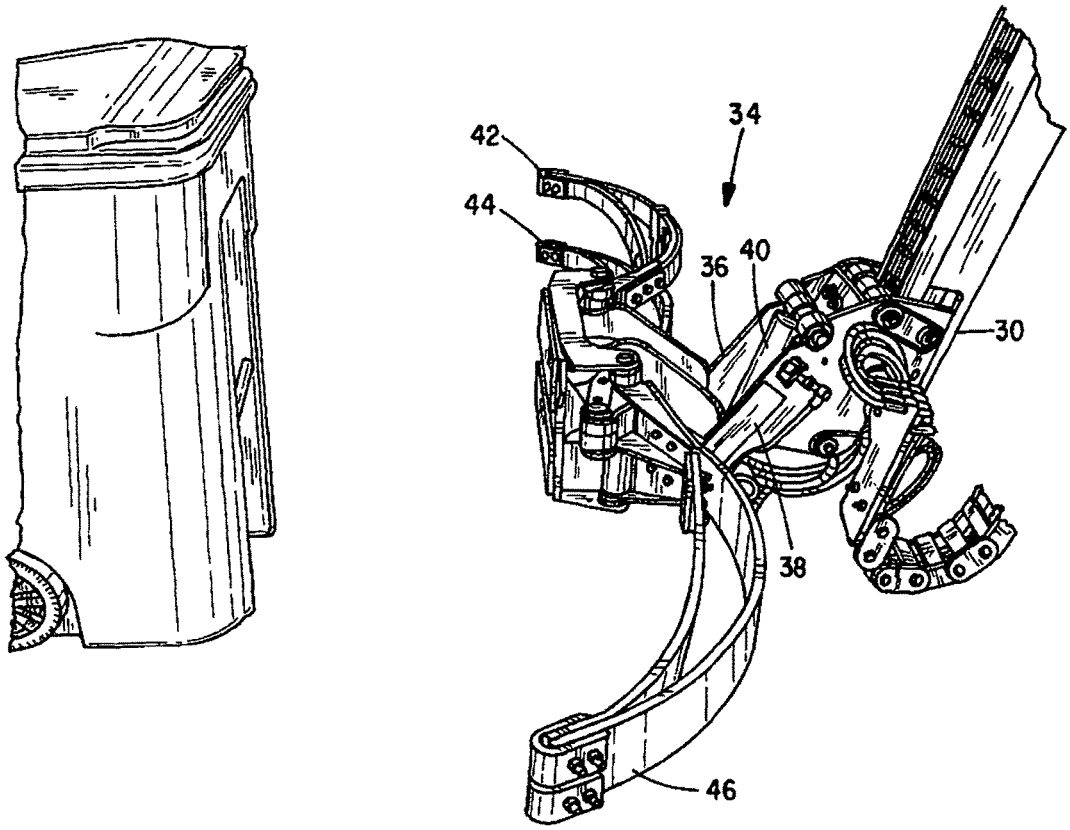
FIGS. 3A-3C depict an approach and grabbing sequence using the automated system of the invention.
Figure 3B:
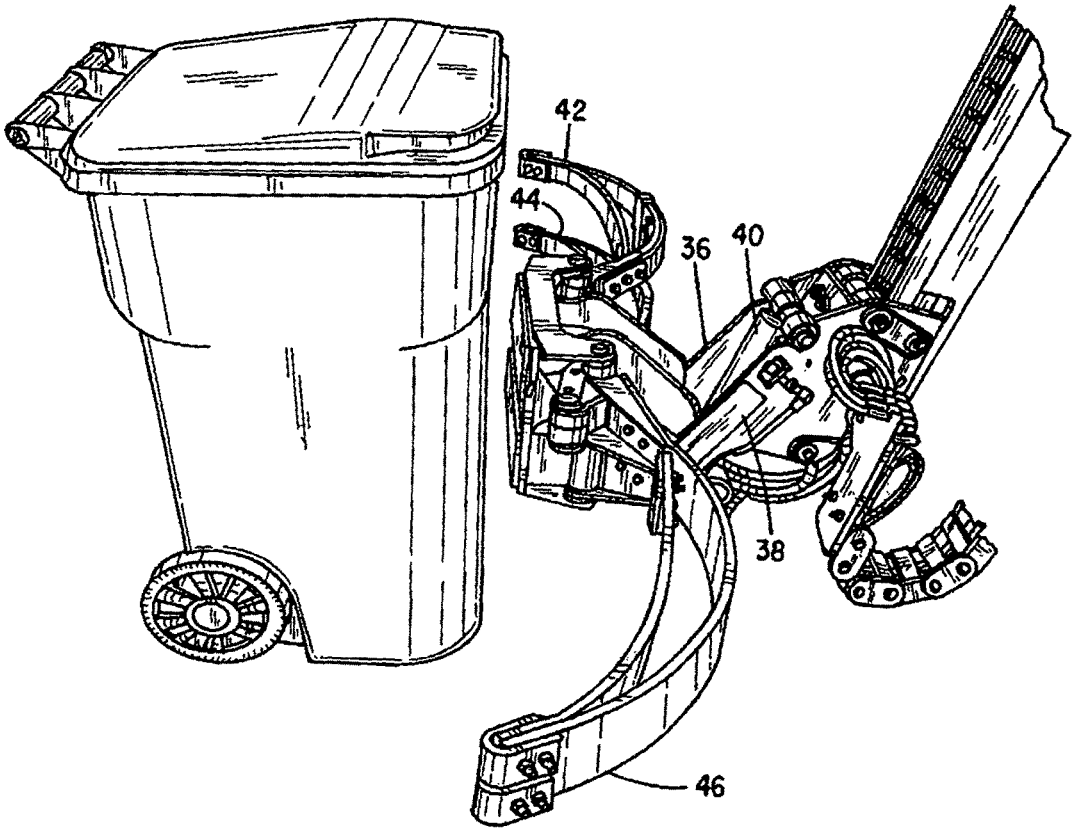
Figure 3C:
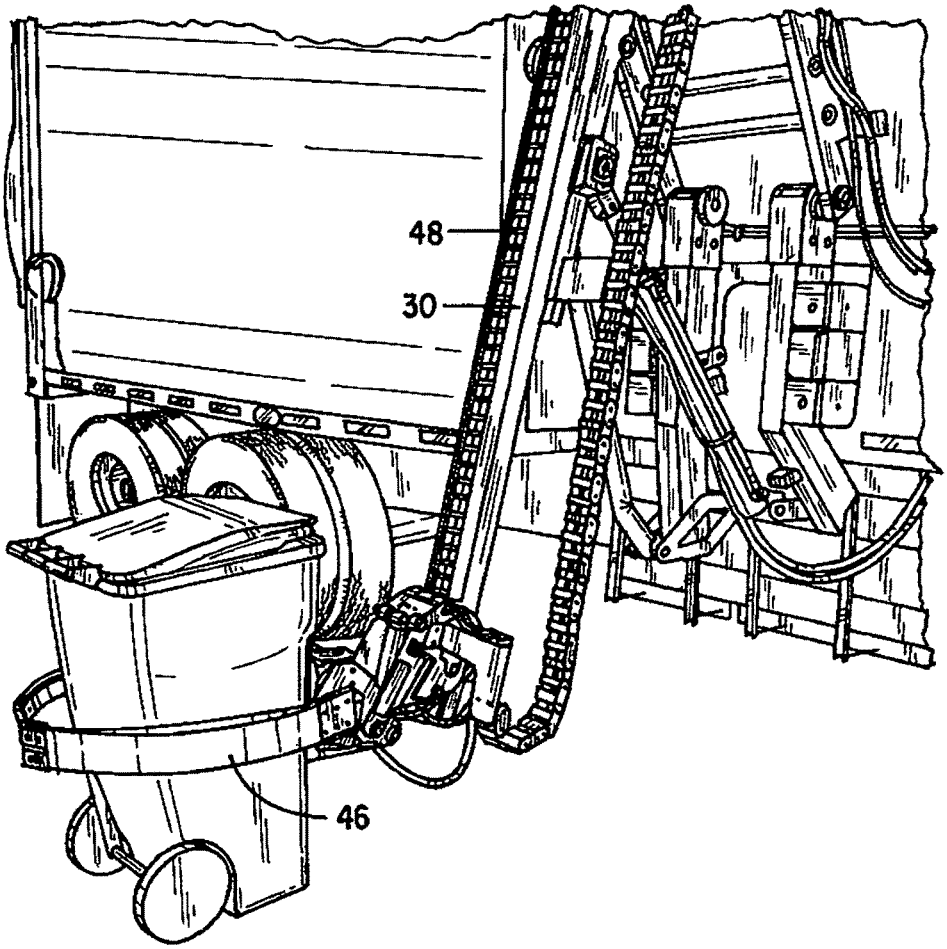

The automated container handling system 12 is best depicted in FIGS. 2-4B and includes a main arm 30 mounted to swivel about a support member 32 at the upper end and is attached to a base assembly 34 by spaced, pivoting members 36 and 38 that are operated by hydraulic cylinder 40 (FIGS. 3A-3C). The base assembly further carries a grabber assembly that includes opposed finger elements, one having split members 42 and 44 and the other is single opposed element 46. The base assembly is designed to traverse upward and downward along the arm 30 using a continuous driven chain 48. Hydraulic fluid and power are supplied through a hose and cable system at 50. FIG. 3C shows the grabber with a seized container. Other figures show the grabber in a retracted, open position. This gives the system a very narrow profile with regard to protruding laterally from the side of a refuse vehicle.

Figure 4A:
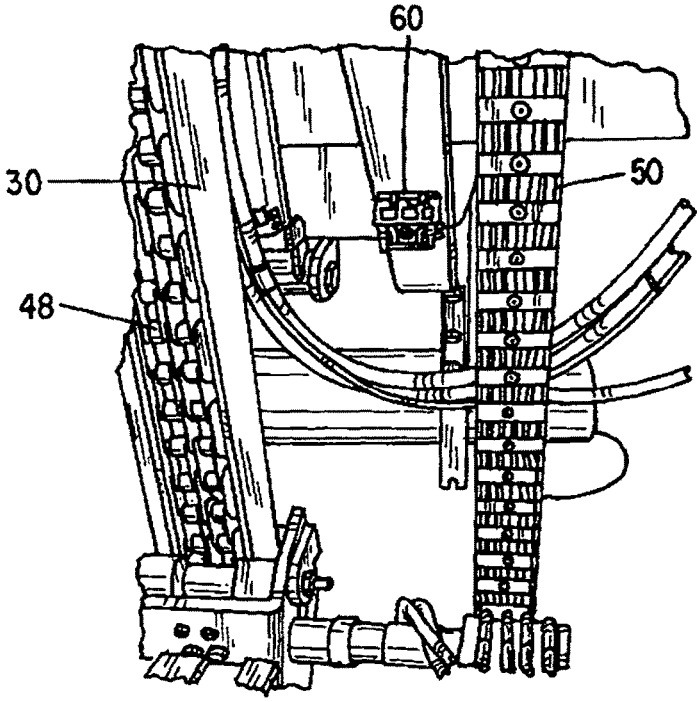
FIGS. 4A and 4B are fragmentary views showing aspects of the container handling system of the invention.
Figure 4B:
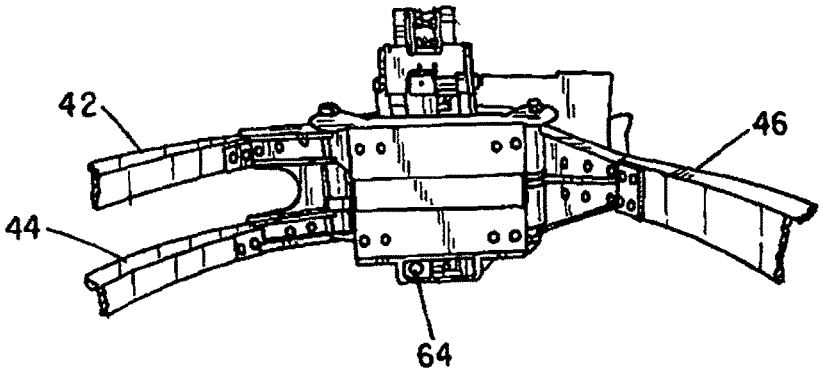

As best seen in FIGS. 4A and 4B, a video camera module is shown at 60 mounted on a member 62 attached to the vehicle behind the arm 30 and a sonar transducer is mounted on the base assembly at 64.

Figure 5:
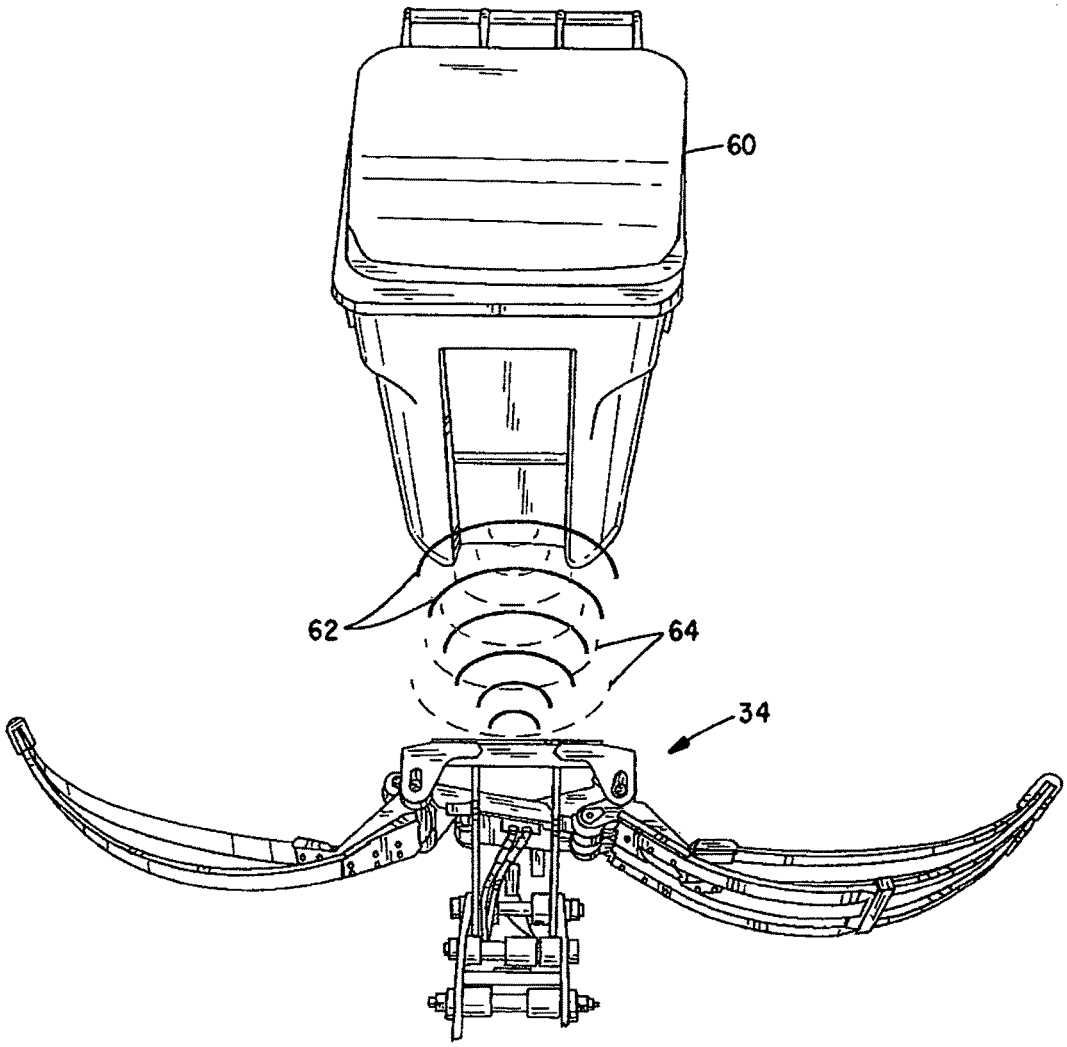
FIG. 5 is a schematic illustration of sonar container targeting in accordance with the invention.

FIG. 5 is a schematic illustration of sonar container targeting in accordance with the invention. Sonar, of course, was originally an acronym for SOund Navigation and Ranging and is a well known technique that uses sound propagation to navigate, communicate with, or detect objects in water or air. The system used in the present invention is an active sonar system that emits pulses of sounds and listens for echoes. This has been found to enable very accurate location of refuse containers and thereby enables accurate automatic control of the container handling process.

As shown in FIG. 5, a container of interest to be emptied is shown at 60. The sonar unit sends out sound pulses 62 and senses echoes 64. As indicated, the use of a sonar system has been found to enable accurate operation of the grabber assembly relative to a container of interest to be emptied. As shown in FIG. 3B, an approach as close as one inch is repeatably possible with the system of the invention.

In operation, the video camera sends a continuous picture to a monitor mounted in the vehicle cab (not shown). The video depicts refuse containers alongside of the vehicle as it moves along a street or alleyway and the driver stops the vehicle when a container to be emptied appears on the monitor. The driver then activates a safety on/off finger trigger, or the like, on a joy stick installed in the cab next to the driver and pushes another button on the joy stick to activate the PLC program which controls the arm during the container emptying cycle. Joy sticks and triggers of the type described are well known and need not be described further to those skilled in the art.

The container emptying cycle is initiated with the arm in the stowed position. With the sonar operating, the arm pivots, extending the base outward toward the container until the sonar transducer indicates the desired proximity of the container just short of hitting the container. This distance might be as close as one inch (2.5 cms). The grabber is then activated to close around and seize the container. The arm then retracts and lifts and dumps the contents of the container into a receiving zone or charge hopper of the vehicle body. The steps are then reversed to return the container to the exact location where it was picked up, release the container and return the arm to the stowed or home position.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An automated container handling system for a refuse vehicle comprising:

a) a camera mounted on the vehicle for obtaining and transmitting real-time video images for locating of containers to be emptied while the truck is moving;

b) a monitor mounted in the vehicle for displaying the real-time transmitted video images of located containers to be emptied enabling accurate alignment of the vehicle with the container;

c) a laterally extendable arm mounted on the vehicle and being constructed with a single central arm element, a base attached to and able to move along said laterally extendable single central arm element, the base being equipped with a converging grabber for seizing and releasing aligned containers to be emptied, wherein extending and retracting of the single central arm element extends and retracts said base laterally with respect to said vehicle;

d) a sonar transducer unit mounted on the grabber for detecting the position of the grabber relative to a container to be emptied as said base is extended;

e) a drive system comprising a single continuous chain drive mounted in said single central arm element for moving said base along said arm to empty and return a seized container; and f) a remotely activated control system for activating a fully automated container handling cycle for extending the single central arm element to the desired proximity of the container, operating the grabber, raising and lowering said base for emptying and replacing the located container, and retracting the arm, said control system in communication with said sonar transducer unit to receive signals used during said fully automated container handling cycle.

2. An automated container handling system as in claim 1 wherein said control system includes a programmable logic controller PLC.

3. An automated container handling system as in claim 1 wherein said container handling system includes a plurality of hydraulic cylinders.

4. The automated container handling system of claim 1 further comprising a hose and cable system operably coupled to said base for providing power to said sonar transducer unit and hydraulic fluid to said grabber.

5. The automated container handling system of claim 4 wherein said control system includes a programmable logic controller (PLC), and wherein said PLC received signals from said sonar transducer unit and provides a plurality of control signals to carry out said fully automated container handling cycle.

6. The automated container handling system of claim 5 further comprising a control button contained within a cab of the refuse vehicle, wherein said fully automated container handling cycle is initiated by an operator pressing said button.

7. The automated container system of claim 6 wherein said container handling system comprises a plurality of hydraulic cylinders, and wherein operation of said hydraulic cylinders are controlled by said controller.

8. The automated container handling system of claim 7 wherein said hose and cable system has a first end coupled to the vehicle and a second end coupled to said base, said hose and cable system containing a plurality of hoses and cables during said fully automated container handling cycle so as to avoid interference with any other structures of said vehicle.

9. An automated container handling system carried by a refuse vehicle to coordinate dumping of a waste container into a storage chamber, the container handling system comprising:

a) a camera mounted on the vehicle for obtaining and transmitting real-time video images of a pick-up area adjacent the vehicle;

b) a monitor mounted in the vehicle for displaying the real-time transmitted video images of the pick-up area thus allowing an operator to locate containers to be emptied and enable accurate alignment of the vehicle with the container to be emptied while the vehicle is moving;

c) a laterally extendable arm rotatably mounted on the vehicle and movable between a transport position and a grasping position, the laterally extendable arm having a single central arm element, a base movably attached to the laterally extendable single central arm element, the base being equipped with a converging grabber for seizing and releasing the container to be emptied, wherein extending and retracting of the single central arm element causes the base to extend and retract in a substantially lateral direction with respect to the vehicle;

d) a sonar transducer unit mounted on the grabber for sensing a position of the grabber relative to the container to be emptied as the base is extended, and to produce a signal when the grabber is a predetermined distance from the container to be emptied;

e) a drive system comprising of a single continuous chain drive mounted in the single central arm element configured to move the base along the arm to a dump position; and f) a remotely activated control system for activating a fully automated container handling cycle in response to an activation signal from the operator, said control system in communication with said sonar transducer unit to receive signals used during said fully automated container handling cycle wherein the automated container handling cycle comprises:

extending the single central arm element so that the base is positioned at the predetermined distance from the container to be emptied;

operating the grabber to grasp the container to be emptied;

activating the drive system to thus cause the based is moved to the dump position thereby causing the contents of the container to be emptied to be dumped into the storage chamber;

further activating the drive system to lower the base, thus causing the container to be replaced at substantially the same position where it was grasped;

releasing the gripper; and retracting the arm to the transport position.

10. The system of claim 9 wherein the activation signal is generated by the operator pressing a single activation button while positioned in a cab of the vehicle.

11. The automated container handling system of claim 10 wherein said control system includes a programmable logic controller (PLC), and wherein the PLC receives signals from the single activation button and the sonar transducer unit, and provides a plurality of control signals to carry out the fully automated container handling cycle.

12. The automated container handling system of claim 9 further comprising a hose and cable system operably coupled to the base for providing power to said sonar transducer unit and hydraulic fluid to said grabber.

13. The automated container handling system of claim 12 wherein said hose and cable system has a first end coupled to the vehicle and a second end coupled to said base, said hose and cable system containing a plurality of hoses and cables during said fully automated container handling cycle so as to avoid interference with any other structures of said vehicle.

* * * * *